United States Patent [19]

Rinio

[11] Patent Number: 4,681,301

[45] Date of Patent: Jul. 21, 1987

[54] ARRANGEMENT FOR LIFTING AND LOWERING OR FOR PULLING LOADS

[75] Inventor: Johannes Rinio, Herne, Fed. Rep. of Germany

[73] Assignee: N.V. Sky Climber Europe S.A., naamloze vennootschap, Belgium

[21] Appl. No.: 816,070

[22] Filed: Jan. 3, 1986

[30] Foreign Application Priority Data

Jan. 22, 1985 [DE] Fed. Rep. of Germany ..... 3501877
Nov. 19, 1985 [DE] Fed. Rep. of Germany ..... 3540906

[51] Int. Cl.[4] ..... B66D 1/00; B66D 1/30
[52] U.S. Cl. ..... 254/333; 254/371
[58] Field of Search ..... 254/216, 225, 333, 334, 254/335, 336, 337, 338, 371, 383

[56] References Cited

U.S. PATENT DOCUMENTS

| | | | |
|---|---|---|---|
| 916,656 | 3/1909 | Bigham | 254/371 X |
| 2,802,636 | 8/1957 | Sandford | 254/333 |
| 3,721,426 | 3/1973 | Käufer | 254/333 |
| 3,729,173 | 4/1973 | Levardon | 254/333 |
| 3,968,953 | 7/1976 | Guangorena | 254/371 X |
| 4,139,178 | 2/1979 | Hippach | 254/333 X |
| 4,193,311 | 3/1980 | Rinio et al. | 254/371 X |
| 4,225,118 | 9/1980 | Ottemann | 254/371 X |
| 4,234,164 | 11/1980 | Ruark | 254/371 |
| 4,345,741 | 8/1982 | Rinio et al. | 254/371 X |

FOREIGN PATENT DOCUMENTS

| | | | |
|---|---|---|---|
| 2054110 | 6/1971 | Fed. Rep. of Germany . | |
| 1035652 | 7/1966 | United Kingdom . | |
| 870347 | 10/1981 | U.S.S.R. | 254/333 |

*Primary Examiner*—Stuart S. Levy
*Assistant Examiner*—Joseph J. Hail, III
*Attorney, Agent, or Firm*—Bacon & Thomas

[57] ABSTRACT

In such an arrangement a faultless clamping of the rope in the traction sheave is necessary. For that purpose two-piece traction sheaves are known whose sheave halves can be pressed together. Further, seat grooves are known wherein the ropes are radially pressed down into the seat grooves. In the so-called V-shaped grooves clamping of the ropes takes place by means of counterweights at the unloaded rope ends. Disadvantages of the known types of construction are unnecessary loads, considerable wear, high weights, bulky arrangements and poor efficiency. For doing away with these disadvantages, two sheaves halves 7, 14 are now mounted parallel to one another and are provided with a common peripheral V-shaped groove. The sheave halves 7, 14 are spring-loaded pressed together and at the periphery of the V-shaped rope groove, rope-supporting elements 20 are fixedly mounted. Thereby a simple construction is achieved, safety has increased and the operation is simplified by requiring no maintenance. A combination of clamping rope groove, V-shaped rope groove and seat rope groove is created. The rope-supporting elements can consist of supporting rollers or shoes.

13 Claims, 8 Drawing Figures

Fig. 7
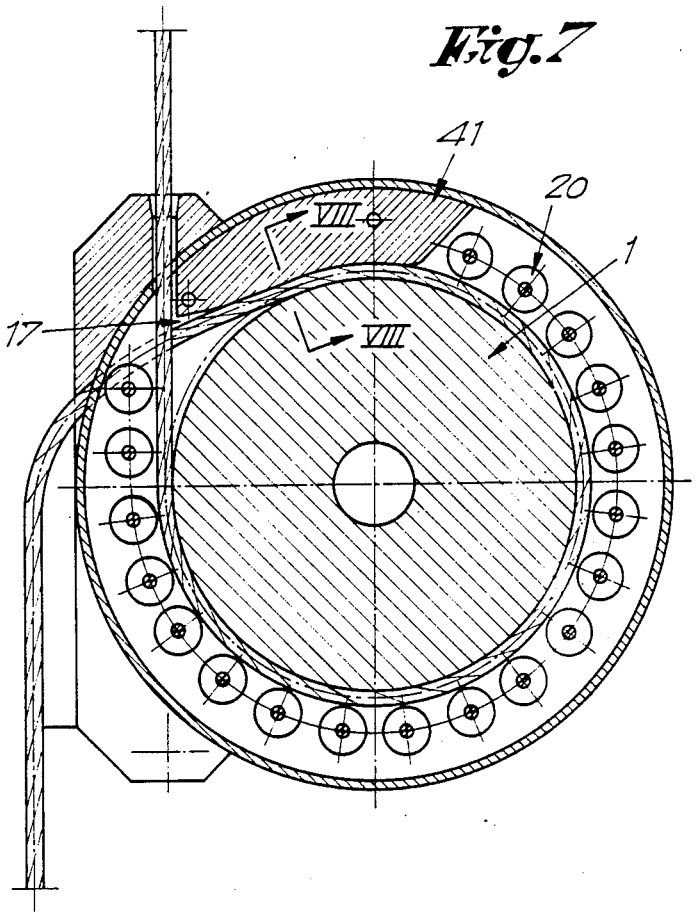
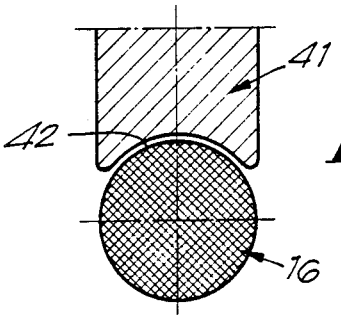
Fig. 8

ARRANGEMENT FOR LIFTING AND LOWERING OR FOR PULLING LOADS

This invention relates to an arrangement for lifting and lowering or for pulling loads.

In such an arrangement with a traction sheave, which is used especially for pulling long wire ropes, clamping of the rope in the traction sheave is necessary (German Patent Specification (DE-PS) No. 10 32 506). Herein, both of the sheave halves are non-spring-loaded pressed together. Their relative adjustment is only possible in one direction during operation. It means that a displacement of one sheave half relatively to the other may be practicable from a larger distance to a smaller one, but not conversely. Consequently, there is a shortcoming in that a thicker rope section following a thinner rope section cannot be received by both sheave halves any longer without an impermissible strong deformation of the rope (pinching, tangling), which shortcoming is absolutely usual in practice.

Another disadvantage is that one sheave half is adjustable by means of a thread. As a result, in a displacement not only lateral forces are exerted on the rope, but also frictional forces in the longitudinal direction thereof, as in a relative displacement the sheave halves are twisted in opposite directions.

It has to be remarked in addition to the mentioned disadvantages that upon inserting the rope, the free terminal rope section has to be threaded by hand, i.e. moved in, almost over the whole periphery of the traction sheave. Therefore the rope groove should have a section which is much greater than the section of the rope such that insertion of the rope is possible without relatively large resistance caused by frictional forces or hooking in the free rope end.

Another shortcoming of the known construction is the use of only one rope idler pulley in the inlet area of the rope. This idler pulley too effects the application of the rope to the sheave halves. This is associated with an extremely high specific surface pressure which is detrimental to the service life of the rope.

Further, seat grooves are known in which the ropes are pressed down radially with the help of pressure means.

Besides there are the so-called V-shaped grooves wherein clamping of the ropes mostly takes place by counterweights at the unloaded end of the rope.

The published German Patent Application (DE-OS) No. 20 54 110 discloses several rope-guiding rollers at the circumference of a traction sheave. This traction sheave is made of only one piece and the rope guide rollers are not fixed but radially freely supported with respect to the traction sheave.

From the UK Patent Specification (GB-PS) No. 10 35 652 too only such rope rollers at the circumference of traction sheave are known which are spring-loaded. No idler pulleys are present along the entire circumference of the traction sheave. The section of the rope groove is not changeable either.

All of the one-piece traction-sheave embodiments with seat grooves and pressure means in radial direction have the disadvantage that the pressure means cannot revolve in the same direction. Consequently, the efficiency is always impaired. Moreover, high loads are placed on these constructions with secondary forces, which constructions, as a result, are expensive and are provided with a corresponding excess weight.

In the one-piece traction-sheave embodiments with V-shaped rope grooves and radially acting pressure means, in addition to the above-mentioned disadvantages of traction sheaves with seat grooves, there is a decrease of drive capacity of the rope that is associated with the wear of V-shaped rope grooves which can result in slipping. These circumstances also apply to the use of V-shaped grooves with counterweights at the unloaded rope section. This construction has the additional disadvantage of limited possibilities of use, since generally they can only be used permanently and not temporarily.

Another disadvantage of the arrangements with a traction sheave is a reduction of the wrapping angle of the rope. The fact is that said reduction results in an increase of the necessary clamping forces, as the required deflection of the rope for passing the just entering or leaving tensioned section of the rope cannot take place already in the groove bottom, but only after leaving the traction sheave at the outer diameter thereof.

It is the object of the present invention to avoid unnecessary loads in the arrangement, to reduce wear as much as possible, to bring the weight as well as the dimensions to a minimum and to bring the efficiency of the arrangement to a maximum.

This object is realized according to the present invention.

Said features or characteristics guarantee a simple and non-sophisticated construction, which increases the safety and simplifies the use of the arrangement by requiring no maintenance. In a sense, a combination of clamping-, V-shaped-and seat-rope grooves is created, wherein the properties of the embodiments are completed and the faults are cleared away. Wire-supporting elements are now being provided and distributed over the whole periphery which distribute the surface pressure in the one as well as in the other operating direction of the arrangement and thereby guide the rope more gently.

The spring-loaded relative position of the sheave halves allows to deal with varying rope sections. If there is no rope in the arrangement, the sheave halves touch one another and the section which is formed by the rope groove in connection with the rope-supporting elements is smaller than the section of a rope to be threaded. Upon threading the rope, the rigid sheave halves now serve as abutment. When the rope is introduced, the movable sheave halves are laterally forced off so that the rope obtains a perfect position in the rope groove, not only in any service conditions but also with any occurring rope diameters in the course of a rope.

Because the rope-supporting elements project into the rope groove, the sheave halves guide the rope faultlessly. This means that in view of the desired rope contact ropes of varying thickness always occupy the optimal relative position.

By applying rope-supporting elements over the whole wrapping area it is guaranteed that upon threading a rope in the rope-groove, a drive action is reached immediately after threading so that the further threading operation can be carried out comparatively smoothly.

A preferred embodiment supporting rollers can be provided over the whole wrapping area. Their common distance corresponds to about half the diameter of a supporting roller. It is also conceivable, however, that at least in the inlet range of the slack rope, a shoe in the form of a circular ring segment is applied instead of supporting rollers. Said shoe optionally can extend over the whole circumference of the traction sheave. It can be formed of one or of several pieces. Preferably, the material of the shoe is a wear-resistant plastic. Because of the great surface area of such a shoe, the surface pressure of the entering rope can be reduced still further.

The use of shoes is especially advantageous if cross-laid ropes are being utilized, as in this type of ropes the separate rope threads run parallel to the longitudinal axis of the rope.

On the contrary, if equal-laid ropes are being used, whose rope threads run at an angle to the longitudinal axis of the rope, preferably supporting rollers are applied.

Therein a construction according to the features of the invention is advantageously being used. A further reduction of surface pressure is associated therewith.

In the embodiment according to the features of the invention it is the primary object of the roller with greater diameter to reduce the surface pressure exerted on the rope when the latter is threaded in slack state or when loads are lowered. This is connected with the advantage that the rope experiences a smaller stress and hence, that a longer service life may be expected.

The large suporting roller, however, can take over another function if the winch is suspended fixedly. In this case the point of suspension finds itself above the rotation axis of the traction sheave. Now, the supporting roller not only serves as an insertion supporting element for the rope, but also as tail element for the slack rope.

In order to improve the inlet procedure, especially of the unloaded rope section, in the traction sheave as well as the outlet procedure of the rope from the traction sheave in the case of small outer diameters of said traction sheaves, the circumferential area of said rope groove is rounded at the outer diameter of said sheave halves.

The invention also brings the wrapping angle of the rope to a maximum for reducing the axial clamping force.

For allowing the insertion of ropes of different strength and diameter, the rope groove is formed in two stages, the radial outer stage having a greater groove angle. The gradual construction can be provided at one groove side or at both.

For bringing the efficiency and the economy of the arrangement to a maximum it is appropriate that the rope-supporting rollers be needle bearings, roller bearings or ball bearings, particularly, however, grooved ball bearings. They may be commercially available products. The bearings may also be made at least partly of resilient materials.

In view of the possibility of adjusting the rope-supporting rollers in the optimal mid-position in the rope groove above the rope after the inlet of the latter, it is suited that the rope-supporting rollers are supported axially movable.

This is achieved particularly and still more advantageously by axially mounting the rope-supporting rollers between springs. The shoes too can be supported that way.

In order to follow the right running direction of the rope it is significant, particularly with narrow rope-supporting rollers, the rope-supporting rollers adjacent the outlet and inlet areas are mounted laterally offset.

The invention is more clearly illustrated hereinafter by means of the examples represented in the accompanying drawings wherein:

FIG. 7 is a section according to the representation of FIG. 2 according to a fifth embodiment, and FIG. 8 is an enlarged representation of a section according to line VIII—VIII of FIG. 7.

Figure 1:
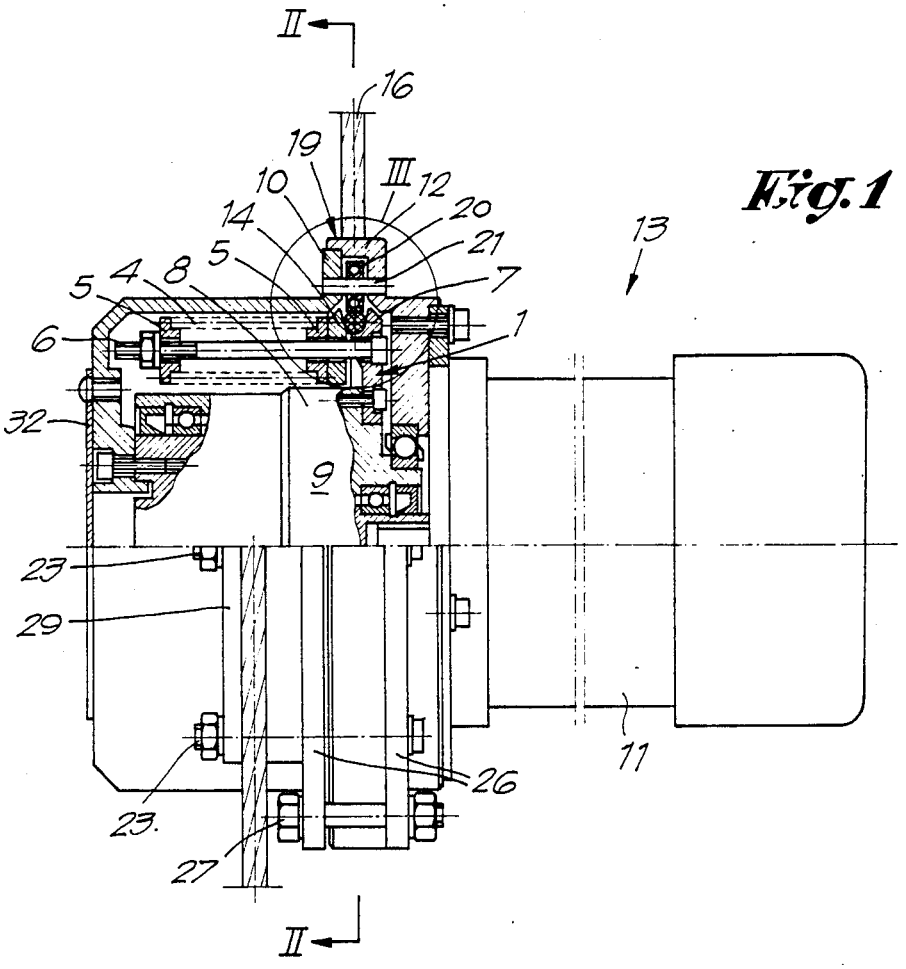
FIG. 1 represents a view of an arrangement for lifting and lowering loads, especially for pulling a wire rope, partly in vertical longitudinal section.

A two-piece traction sheave 1 with V-shaped rope groove 2 of 20° groove angle (FIGS. 1, 3 or 5) or with two-stage rope grooves 3 (FIG. 4) is laterally pressed together in axial direction. Therefore rotating springs 4 are used, which are supported in guiding sheaves 5 and pre-stressed by screws 6. Said screws are countersunk with their heads in an axially non-displaceable sheave half 7 of the traction sheave 1 (FIGS. 1 and 3 to 5).

For torque transfer, sheave half 7 is screwed and pinned with the rotating housing 8 of a small and special transmission 9 that can be built extremely easily. It forms a whole with said transmission 9.

For taking up the torque, transmission 9 is centred at housing part 10 of arrangement 13, screwed and pinned. It is driven by a braking motor 11, which in its turn is centred and screwed at housing part 12 of arrangement 13 (FIG. 1). Motor 11 can also be replaced, e.g., by a non-return crank handle.

The axially movable sheave half 14 of traction sheave 1 (FIGS. 1 and 3 to 5) is pressed against sheave half 7 by springs 4. Said sheave half 14 is carried along for torque transfer via screws 6 which are led through said sheave half 14. Centring of the latter sheave half occurs with the necessary clearance for the needed axial reciprocation either on the extended groove base 15 of sheave half 7 or on the outer diameter of transmission 9 (FIG. 1).

Figure 2:
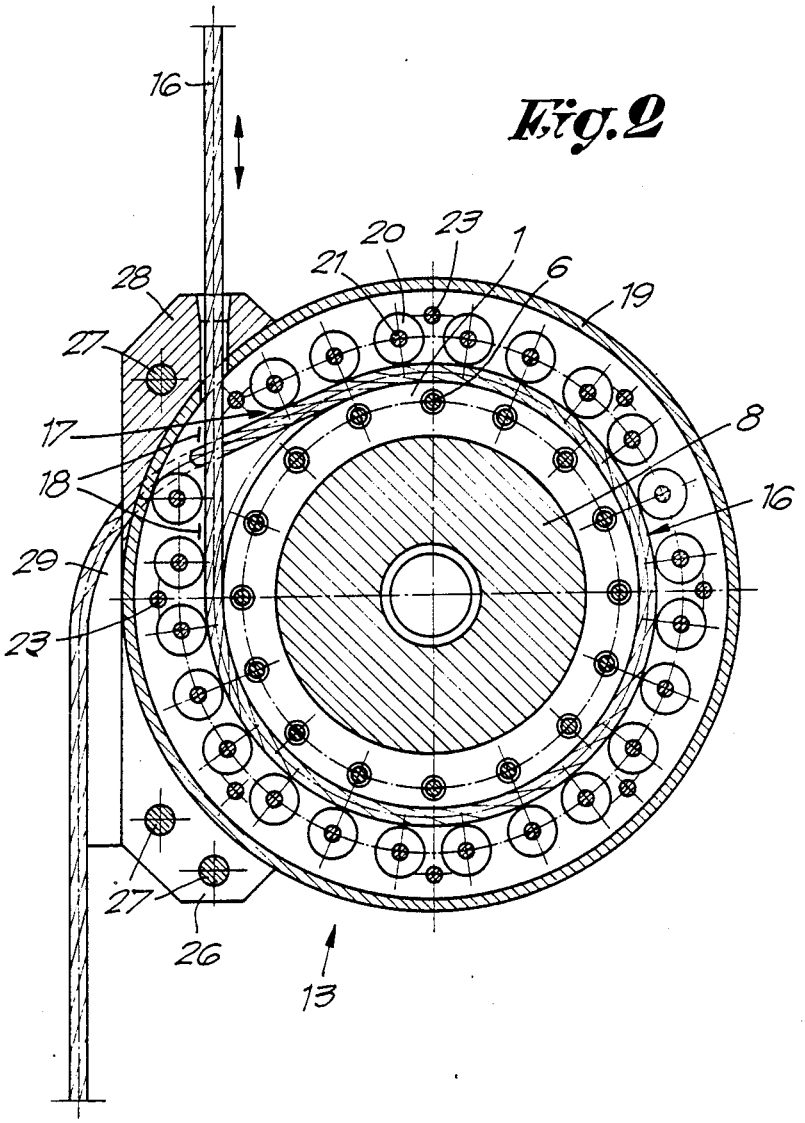
FIG. 2 represents a section through the arrangement of FIG. 1 according to line II—II.

Fixedly positioning rope-supporting rollers 20 are mounted on axles 21 over the whole wrapping area of wire rope 16 in traction sheave 1 as well as in the outlet area 17 and the inlet area 18 within housing 19 (FIGS. 1 to 5). At their turn axles 21 are attached to the one side in housing part 12 and to the other side in housing part 10 of housing 9. Separation 22 as well as centring of both housing parts 10, 12 find themselves between both displacements of axles 21. Both of the housing parts 10, 12 are connected by eight screws 23 to the common housing 19 of arrangement 13 (FIGS. 1 and 2).

Figure 3:
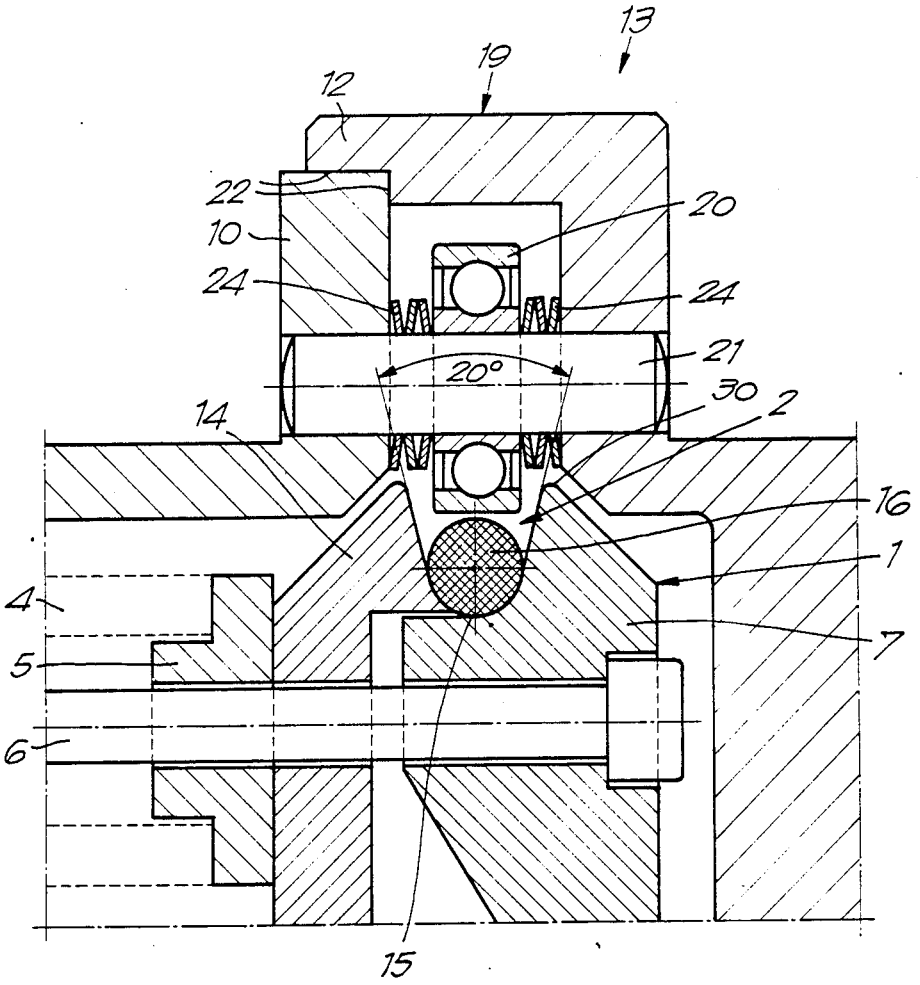
FIG. 3 represents an enlargement of the cut-out view III of FIG. 1 according to a first embodiment.
Figure 4:
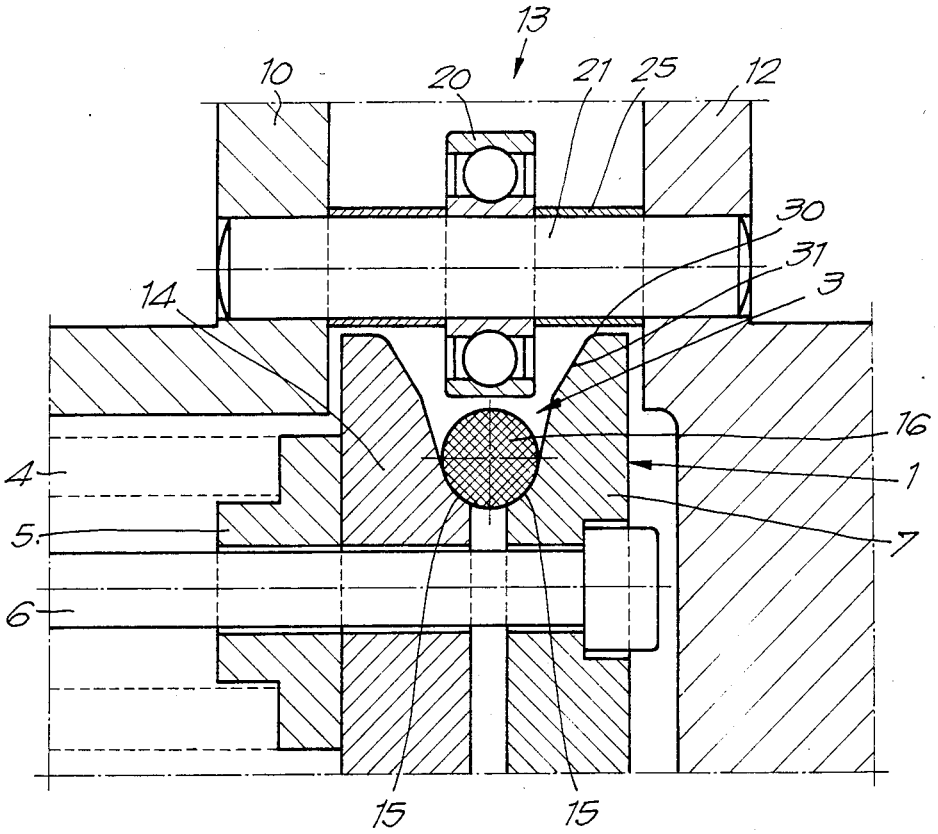
FIGS. 4 and 5 represent the same cut-out view according to two other embodiments.
Figure 5:
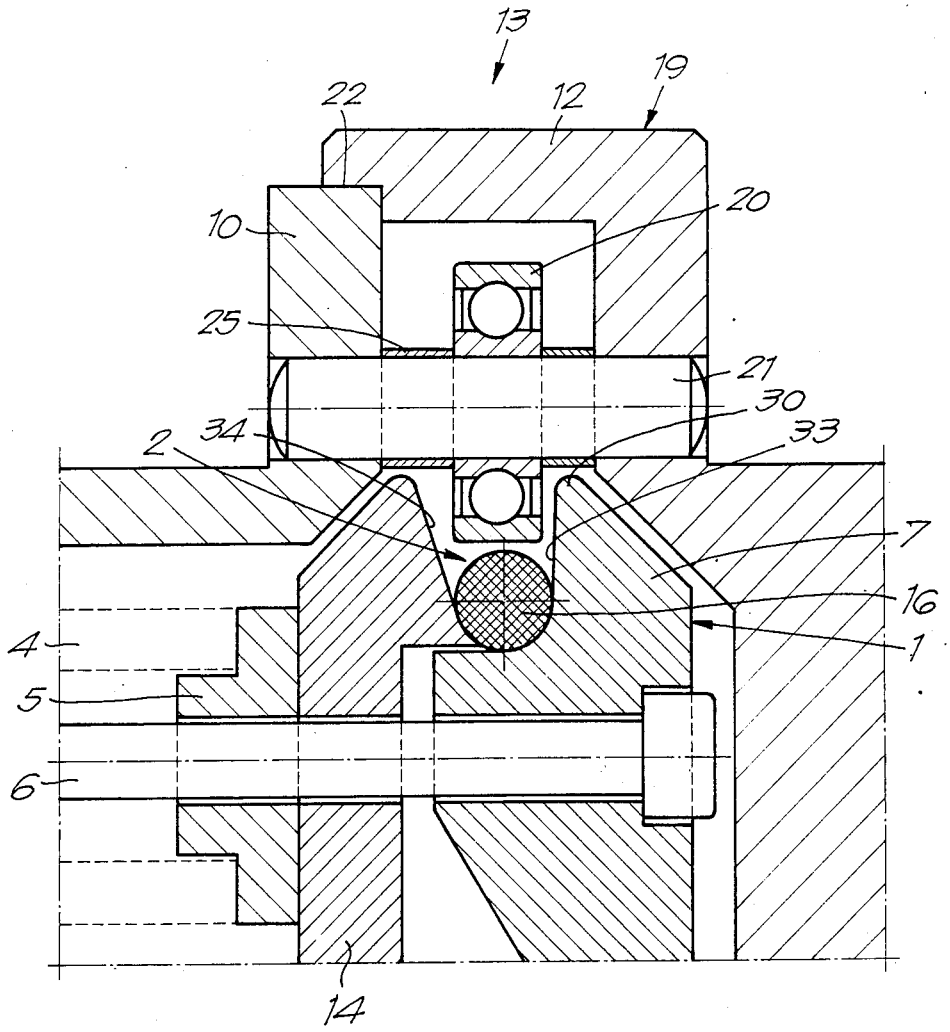

Rope-supporting rollers 20 in FIG. 3 are clamped between springs 24 for reciprocation on axle 21 and FIGS. 4 and 5 are fixedly positioned via spacing tube 25 between the housing parts 10 and 12.

For taking up the anchoring of arrangement 13 two lateral tie blocks 26 are provided (FIGS. 1 and 2), which are fixedly screwed to housing part 19 by three of the eight connecting screws 23. Said tie blocks 26 can take as much as three anchor bolts 27 and also hold the rope inlet piece 28 and the rope outlet piece 29.

First of all, derailment of wire rope 16 within the arrangement 13 upon threading is prevented by the rope-supporting roller 20. Threading occurs by simply forcing wire rope 16 by hand into the guiding hole of rope-inlet guiding segment 28 (FIG. 2) with running motor 11.

Wire rope 16 is then pressed into the V-shaped rope groove 2, 3 over the first rope-supporting roller 20 in the inlet area 18 and carried along automatically by traction sheave 1. It is steered aside in outlet area 17 by suitable guides and past the rope section already entered guided laterally out of housing 19 and led over rope-outlet guiding segment 29 (FIG. 2).

In the inverted direction of pulling the rope-supporting roller 20 in outlet area 17 also performs the task of threading the wire rope 16 into rope groove 2, 3 of traction sheave 1, which rope at this side in permanently unloaded.

For sparing wire rope 16 at the inlet and outlet of rope groove 2, 3 the area 30 at the outer diameter of rope groove 2, 3 is rounded off (FIGS. 3 to 5). For being able to use wire ropes 16 with varying diameters without increasing the outer diameter of traction sheave 1, a two-stage rope groove 3 is provided in FIG. 4 whose outer stage 31 has a greater groove angle for properly entering a little thicker wire ropes 16.

Wire rope 16 is loaded and pressed in the inlet area 18 onto the groove base 15 of traction sheave 1 (FIGS. 2 to 5). The provided groove angle of rope groove 2, 3 of 20° has been obtained experimentally and is the most favourable. Only in the outlet area 17 a low pressure rope on the rope-supporting roller 20 is attained herein, which, however, does not harm said wire rope 16.

The represented cover 32 (FIG. 1) has only to close the opening in housing part 10 of arrangement 13.

In order to reduce the wrapping angle of wire rope 16 for decreasing the axial clamping force to a maximum, according to FIG. 5 the bisectrix of rope groove 2 with respect to the perpendicular on the rotation axis of traction sheave 1 is inclined. Herein, groove side 33 of the undisplaceable sheave half 7 is only slightly inclined to the perpendicular, whereas on the contrary, groove side 34 of the axially displaceable sheave half 14 has a siderably larger inclination.

Figure 6:
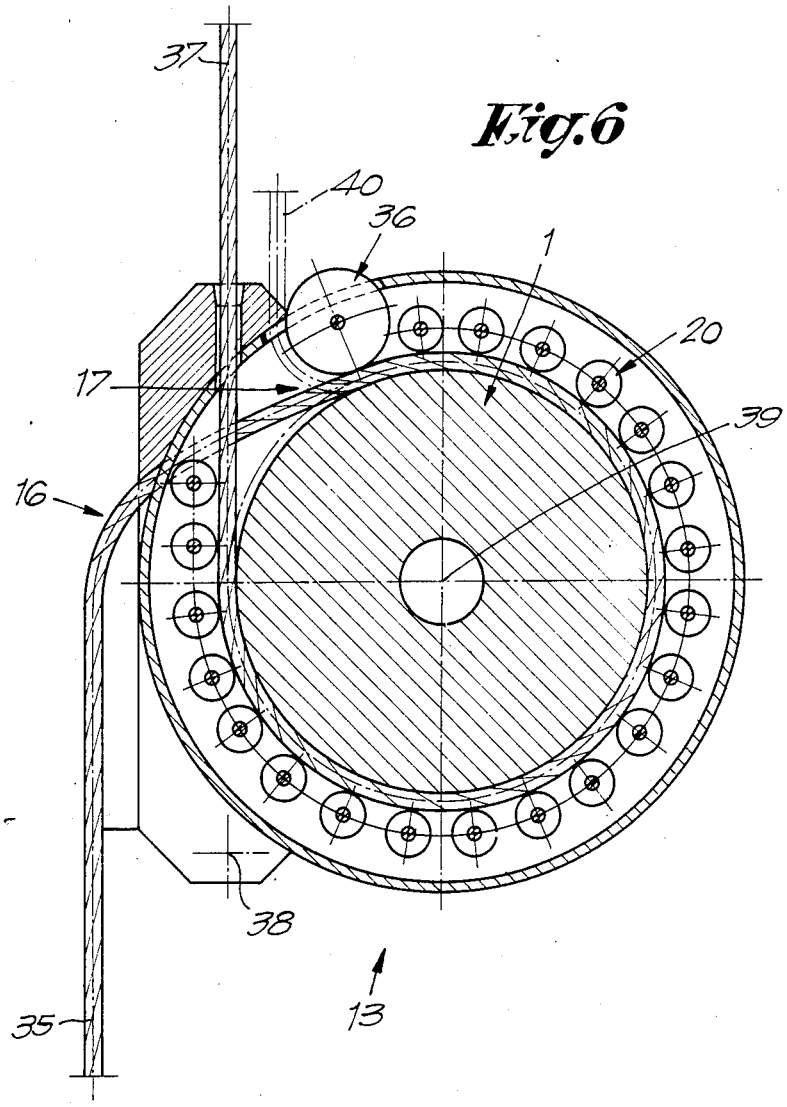
FIG. 6 is a section according to the representation of FIG. 2 according to a fourth embodiment.

In the embodiment according to FIG. 6, a supporting roller 36 is provided in the area 17 of the slack rope 35, the diameter of said roller being twice as large as that of the other supporting roller 20. Said large supporting roller 36 primarily performs its function during the threading operation of the slack rope 16 or during a lowering operation, i.e. when the arrangement 13, e.g., is fixed to a platform and rope section 37 is taut. In this case rope section 35 in principle runs between supporting roller 36 and traction sheave 1. The large supporting roller 36 reduces the surface pressure exerted on rope 16. This is associated with the advantage that said rope 16 experiences a smaller load and hence may be expected to have a longer service life.

However, supporting roller 36 can fulfil still another function when the arrangement 13 is fixedly supported and the load is suspended from rope section 37. In this case, the suspension point 38 is above the rotation axis 39 of traction sheave 1. In this case, said supporting roller 36 does not only serve the purpose of inlet supporting element for rope 16, but also of tail element for the slack rope 40 (dash-and-dot route).

In FIG. 7 an embodiment is represented according to which a shoe 41 in the form of a circular ring segment is mounted at least in area 17 of the slack rope 35 instead of supporting roller 20. Said shoe 41 can also extend over almost the entire periphery of traction sheave 1 instead of supporting roller 20. It can be made of one or of several pieces. Preferably, the material of said shoe 41 is a wear-resistant plastic as has been used, e.g., for making conveying chutes.

FIG. 8 shows that said shoe 41 can have suitable outlines 42 at the periphery of rope 16. But the supporting rollers 20 too can be suitably grooved at their periphery in accordance with the section of the rope.

Shoes 41 are advantageously used when cross-laid ropes are being applied. If on the contrary, equal-laid ropes are being used wherein the wire ropes are at an angle with respect to the longitudinal axis of rope 16, supporting rollers 20 are preferably used.

I claim:

1. An arrangement for moving a load, such as by lifting, lowering or pulling, having a flexible wire rope attached thereto, comprising:

(a) a housing having a rope inlet and a rope outlet;

(b) a first sheave half mounted in the housing so as to rotate about a central axis;

(c) a second sheave half mounted within the housing so as to rotate with the first sheave half;

(d) drive means to rotate the first and second sheave halves about the central axis;

(e) spring means to bias the second sheave half toward the first sheave half;

(f) a rope gripping groove defined by the first and second sheave halves to grip the wire rope such that rotation of the first and second sheave halves causes the wire rope to move along its length;

(g) a plurality of rope-supporting rollers attached to the housing such that the rollers are located adjacent to the periphery of the first and second sheave halves so as to keep the wire rope from jumping out of the rope gripping groove, and are disposed around a major portion of the circumference of the first and second sheave halves;

(h) an axle attached to the housing and rotatably supporting each rope supporting roller; and, (i) spring means acting between the housing and each rope supporting roller so as to bias the roller to a position above the rope gripping groove.

2. The arrangement according to claim 1 wherein all of the rope supporting rollers have substantially the same diameter.

3. The arrangement according to claim 1 wherein the rope supporting roller nearest the rope outlet has a diameter greater than that of the remaining rope supporting rollers.

4. The arrangement according to claim 1 further comprising a guide shoe extending about a portion of the circumference of the first and second sheaves not covered by the plurality of rollers.

5. The arrangement according to claim 4 wherein a radially inner surface of the guide shoe is concavely curved in cross-section.

6. The arrangement according to claim 1 wherein edges defining the radially outermost portion of the rope gripping groove are rounded in cross-section.

7. The arrangement according to claim 1 wherein a side of the rope gripping groove defined by the second sheave half extends at a greater angle to a plane extending generally perpendicular to the central axis than a side of the groove defined by the first sheave half such that the bisectrix of the rope gripping groove extends at an acute angle to the plane.

8. The arrangement according to claim 1 wherein sides of the first and second sheaves defining the rope gripping groove each have a radially inner portion extending at a first angle to a plane extending substantially perpendicular to the central axis and a radially outer portion extending at a second angle to the plane, the second angle being greater than the first.

9. The arrangement according to claim 1 wherein rope supporting rollers are located adjacent the rope inlet and the rope outlet.

10. The arrangement according to claim 1 further comprising anti-friction bearing means associated with each of the rollers.

11. The arrangement according to claim 1 wherein the housing comprises two sections and wherein the plurality of axles are attached to and extend between the housing sections.

12. The arrangement according to claim 11 wherein the spring means is interposed between each housing section and the roller.

13. The arrangement according to claim 1 comprising rollers located adjacent the rope inlet and the rope outlet, such rollers being laterally offset with respect to each other.

* * * * *